United States Patent [19]

Johnsson

[11] 4,008,992

[45] Feb. 22, 1977

[54] VALVE SYSTEM, PARTICULARLY FOR CIGARETTE LIGHTER

[75] Inventor: Lars Bertil Johnsson, Jonkoping, Sweden

[73] Assignee: Societe anonyme dite Etablissement GENOUD & Cie., Venissieux, France

[22] Filed: Nov. 18, 1974

[21] Appl. No.: 524,889

[30] Foreign Application Priority Data

Nov. 20, 1973 France ..... 73.41913

[52] U.S. Cl. ..... 431/344; 251/121

[51] Int. Cl.[2] ..... F23Q 2/16

[58] Field of Search ..... 431/130, 131, 142, 143, 431/150, 254, 255, 276, 277, 344; 251/121

[56] References Cited

UNITED STATES PATENTS

| | | | |
|---|---|---|---|
| 3,213,649 | 10/1965 | Sakamoto | 431/344 |
| 3,525,497 | 8/1970 | Zalar | 431/143 |
| 3,533,721 | 10/1970 | Hocq | 431/344 |
| 3,695,819 | 10/1972 | Tricot | 431/344 |
| 3,884,618 | 5/1975 | Neyret | 431/254 |
| 3,895,905 | 7/1975 | Nissen | 431/254 |

FOREIGN PATENTS OR APPLICATIONS

| | | | |
|---|---|---|---|
| 1,360,987 | 6/1963 | France | 431/131 |

*Primary Examiner*—Carroll B. Dority, Jr.
*Attorney, Agent, or Firm*—Karl F. Ross; Herbert Dubno

[57] ABSTRACT

A valve system particularly for cigarette lighters comprises a pressure control, escape or relief valve in association with a closure or blocking valve with a common fluid-flow obstructing means for the two valves.

10 Claims, 6 Drawing Figures

VALVE SYSTEM, PARTICULARLY FOR CIGARETTE LIGHTER

The invention relates to a valve system comprising a pressure-reduction valve (escape valve) and a stop valve, both associated with a conduit for fluid, preferably a gas. This system is preferably, but not exclusively, intended for gas cigarette lighters, more particularly for so-called "disposable" cigarette lighters.

Conventional lighters of this type generally comprise a screw-threaded tubular valve body which is able to be rotated, this valve body being inserted in a screwthreaded bore in the lighter casing, the bore is provided with a narrow axial cavity at its inner end. This cavity is connected to the fuel reservoir of the lighter by means of a second conduit in which a porous wick may be inserted. The valve body is associated with means, such as a knurled wheel or lever which facilitates the rotation of the valve and, owing to the screwthreading of the body, axial displacement of the latter in its housing; it is also associated with an escape valve and a stop valve, separated from each other, the first ensuring the reduction in pressure of the gaseous fluid and the second stopping the flow of said gaseous fluid. The pressure-reduction valve (escape valve) is located in the bottom of the aforesaid housing in the lighter casing and comprises a counterpressure plate and a disc or washer of fibrous material which is interposed between the bottom of said housing and the counterpressure plate. The fibrous material may be compressed or expanded along the axis of the lighter casing in order to control the flow of fuel through the cavity as well as the height of the lighter flame, by rotating the knurled wheel or control lever associated with the valve body.

The closure valve or stop valve generally comprises a rubber closure member which co-operates with the outer edge of the end of the cavity in the inner end of the valve body (valve seat) and is inserted inside a tubular ignition nozzle constituting the burner, this nozzle being provided with a transverse hole through which the axial orifice of the burner communicates with the inside of the valve body. This ignition nozzle is associated with and engaged by a pivotable operating lever comprising two arms which, when the stop valve is in the closed position, compresses the rubber closure member against the valve seat and which makes it possible to raise said ignition nozzle to allow the flow of gaseous fluid through the escape valve and the stop valve, in order to cause the ignition of the gas released. The closure of the stop valve may also be directly ensured by a spring.

Valves of this type are generally simple, effective and quite reliable. Nevertheless, they have several significant drawbacks. Thus, for example, the flame of many lighters is frequently disturbed by a persistent flickering which, in certain cases, is a nuisance. Generally, this flickering is caused by the expulsion of droplets of fuel from the cavity located at the bottom of the valve body and, during the evaporation of the liquid fuel or during the boiling process. Certain lighter manufacturers have attempted to solve this problem by enlarging the cavity and by partly filling it with a metal cylinder projecting from the counterpressure plate and passing through a perforation in the washer of fibrous material. In this way, evaporation is limited to a very narrow slit which results in decrease in the dimension of the fuel droplets and thus a reduction in flickering of the flame.

Furthermore, the flame of most lighters of the above type is not at the present time of intrinsically maximum height, which constitutes a main drawback. One solution to this problem consists, at the time of manufacture, of manually adjusting the flame of each lighter in the factory and then of inserting, in place of a freely rotating knurled wheel, a regulating lever which can only be moved within certain limits. Clearly, a process of this type is both expensive and unreliable.

Furthermore, faults, errors or omissions during assembly of the parts of the lighter may have quite dangerous consequences. Thus, for example, if the disc of fibrous material or the counterpressure plate should be missing for any reason, in the pressure reduction valve, the flow of fluid is unlimited. The resulting flame which has a height of the order of 50 centimeters may be dangerous or have disastrous consequences.

Finally, the knurled wheel for regulating the height of the flame is, in most lighters, much too difficult to rotate and there is a frequent risk of breaking ones finger nails during this operation. The reason for this state of affairs is that the fibrous material in the pressure reduction region must be very compact in order to ensure the desired permeability. The high pressure thus applied signifies not only that the escape valve is difficult to regulate but also that a non-resilient deformation (in particular a blister) may be produced in the fibrous material, owing to the variation of its permeability over a period of time. A valve which is appropriately regulated initially may thus require readjustment after a certain storage time.

The main object of the invention is to eliminate the aforesaid drawbacks and to provide a valve system, particularly for a lighter, which makes it possible: to appreciably reduce the flickering of the flame, to maximize the height of the latter, to eliminate the dangerous consequences of an assembly error in the mounting of the valve and to reduce the force required for manual regulation of the escape valve. The valve system according to the invention is characterised in that it comprises a member for blocking the fluid, which is common to the pressure reduction valve forming the escape valve and to the closure valve forming the stop valve.

This main characteristic constitutes the basis of the other structural features by means of which the aforesaid objects are achieved.

Further features and advantages of the device according to the invention will become apparent from the detailed description of preferred embodiments given with reference to the accompanying drawing in which:

FIG. 1 shows:

Figure 1:
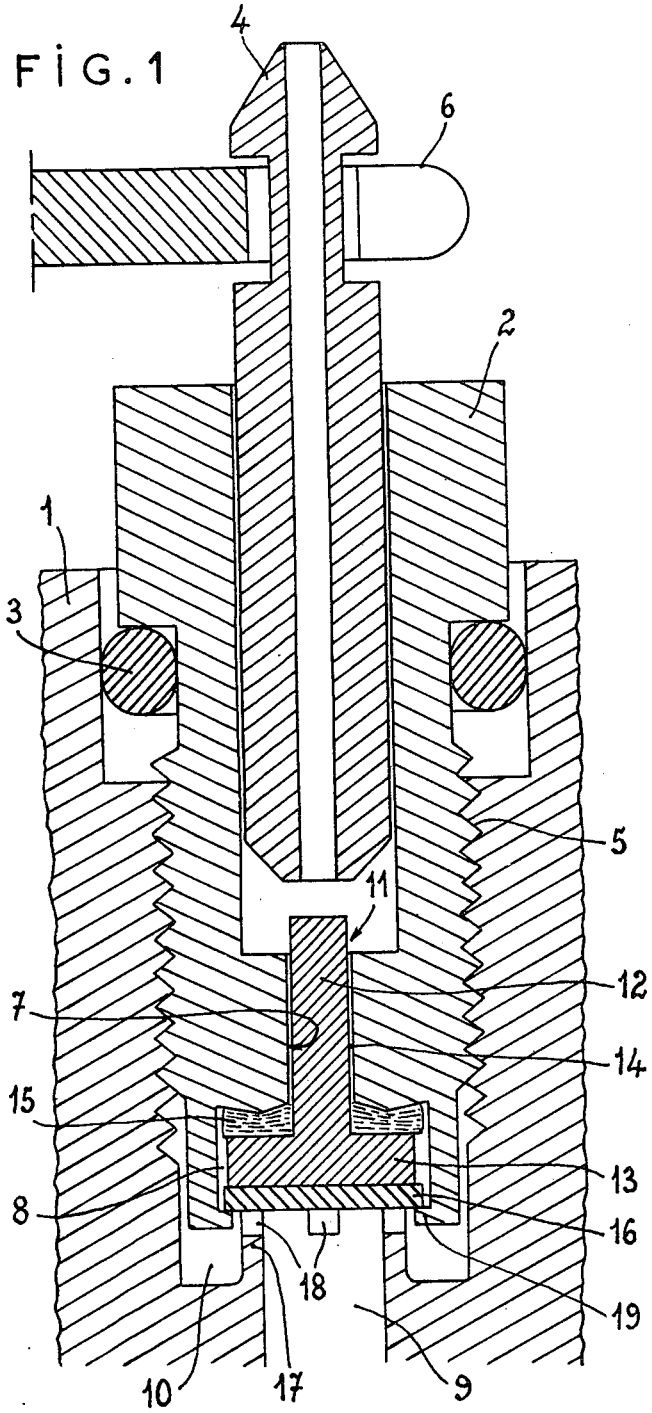
FIG. 1 is a sectional view to an enlarged scale of the ignition burner, of the valve system and the associated parts of a lighter, according to a first embodiment of the invention.

— A lighter casing 1 of plastic material or another material and which comprises a reservoir (not shown) for liquid or gaseous fuel;

— a valve body 2 which is inserted in a bore 10 in the lighter casing and engaged in the latter by a screwthread 5;

— an annular sealing ring 3 which opposes the escape of gas through the screwthread 5 of the bore 10 of the lighter and of the valve body;

— an ignition burner nozzle 4 and an operating lever 6 which makes it possible to raise the burner nozzle in order to enable the fluid to escape when the lighter is to be lit.

The inner end of the valve body 2 is provided with a cavity 7 which has a greatly enlarged substantially circular/cylindrical mouthpiece 8 and which is connected to a fuel conduit 9 opening into the fuel reservoir and inside which it is possible to provide a wick (not shown).

According to the invention, the valve system comprises a fluid blocking member designated by the reference numeral 11 and which is common to the escape valve and to the stop valve. This member 11 comprises a first part in the form of a substantially cylindrical pin 12 located in the cavity 7 of the valve body 2 and which is included in the closure valve of the lighter. This part which is made from rubber or similar resilient material, defines with the wall of the cavity 7, when the closure valve is in the open position (FIG. 1) a narrow annular passage or clearance 14 for the combustible fluid, this clearance thus constituting an evaporation region. When the right-hand part of the operating lever 6 is not in the raised position (shown in FIG. 1) but occupies its normal position in which it is retained by a spring or similar device, this lever axially compresses the portion of the pin 12, by pressing on it by the burner nozzle 4, in order to expand the transverse section of this pin and cause its periphery to bear against the wall of the cavity 7, thus forming the stop valve. Moreover, the one-piece fluid blocking member 11 comprises a second part which is preferably circular/cylindrical, in the form of an annular outwardly extending flange or plate 13 which is also made from rubber or a similar material and which is preferably integral with the pin or stem 12. This second part 13 of the fluid blocking member, which is preferably coaxial with the first part 12, is comprised by or forms part of the pressure reduction valve (escape valve) of the lighter and is located in the enlarged mouthpiece or recess 8 of the valve body 2. This second plate-shaped part 13 is associated and co-operates, firstly, with a washer 15 of porous material and secondly, with a disc 16 made from metal or another rigid material, which are both included in the pressure-reduction valve (escape-valve) and located in the mouthpiece or cavity 8. The washer 15 which surrounds the outer part or base of the pin 12 is located between the bottom of the mouthpiece 8 and the plate-shaped part 13 of the fluid blocking member 11, on the side opposite that of the disc 16, the latter bearing against an annular wall 17 which projects from the bottom of the bore 10. A certain number of radial slots 18 provided in this wall 17 facilitate a free passage for the fuel. Three or four arresting abutments 19 which project in the bottom of the valve body 2 limit the displacement of the counterpressure disc 16 with respect to the valve body 2. These abutments are appropriately produced during a cold compression operation after the assembly of the porous washer 15, rubber closure member 11 and counterpressure disc 16. A complete unit is thus obtained combining a pressure-reduction valve (escape valve) and a closure valve (stop valve).

The abutments 19 are preferably arranged such that the plate-shaped part 13 of the rubber blocking member 11 is always somewhat compressed. A minimum pressure is thus permanently applied to the porous washer 15 and the flow of fluid is in this case maximised. Tests have shown that there was no need for this minimum pressure to be high.

The regulation of the flame is carried out in conventional manner, i.e. by screwing the valve body 2 in the mouthpiece 10, which compresses the porous washer 15 and the part 13 of the blocking member 11.

The valve system according to the invention has considerable advantages, both as regards its manufacture as well as its assembly, its operating characteristics and its safety. Thus, the height of the flame is maximized intrinsically since the porous washer 15 is always subject to a certain compression, even if the regulating wheel is rotated well beyond the normal regulation region.

Moreover, the device according to the invention provides complete safety for the lighters, particularly as regards the consequences of possible assembly errors.

In the lighter of the invention, three particularly dangerous assembly errors may occur:

a. The porous washer 15 was omitted. Due to the pre-stressing of the plate-shaped part 13 of the rubber closure member, this part is compressed against the bottom of the mouthpiece 8 of the valve body 2, since the minimum compression of this part 13 is greater than the thickness of the washer 15; the stop valve is thus permanently closed whatever the position of the regulating wheel for the valve body.

b. The blocking member 11 was omitted. The stop valve is thus permanently open and the pressure reduction valve does not operate. Consequently, the contents of the lighter are emptied immediately after it is filled; a dangerous situation for a user this does not occur.

c. The counterpressure disc 16 has been omitted. If the assembly unit is maintained in a position such that the base of the valve body 2 is directed downwards before being inserted in the bore 10, the rubber closure member 11 will automatically fall. The lighter assembled in this way will thus be incapable of retaining the fuel.

Furthermore, the system according to the invention has another considerable advantage owing to the fact that since the valve forms a complete unit in itself, it is possible to nail an automatic inspection of the operation of the escape valve before the final assembly of the parts of the lighter is carried out.

Apart from the above advantages, it is also necessary to note that the force required for the regulation is appreciably reduced with respect to that required in lighters of known type and this is for the three following essential reasons:

a. The compressive pressure is distributed more uniformly, since it is applied by means of the resilient rubber plate 13, b. When the valve body 2 is screwed inwardly, the greatest part of the elastic deformation is absorbed by the part 13 of the closure member. The porous washer 15 may thus be thinner, with an increased resistance to the flow of fluid for a given pressure, whereas, at the same time, the angle of opening of the valve body increases owing to the compressibility of the part 13 of the rubber closure member 11. These two effects make the regulation of the valve easier;

c. It is desirable that the heat transmitted to the escape valve not be too great. Owing to the present construction, one of the walls adjacent the region 15 of the escape valve comprises the rubber plate 13, which is a very poor conductor of heat. The heat transmitted to the pressure reduction region passes along a single wall, instead of two conductive walls as in known lighters; the reduction region may thus be wider, with an increased resistance to the flow of fluid for a given applied pressure.

As regards the structural characteristics of the rubber fluid blocking member, attention is drawn to the following requirements:

a. the rubber should be solely subject to one pressure, b. the rubber member should be designed such that it may expand freely (up to a certain extent) in directions at right-angles to the applied pressure, and c. the relative deformation of the rubber member should be limited and not exceed 25%.

As regards the material constituting the fluid-blocking member 11, it is important that:

a. the rubber is not damaged by the fuel, b. the swelling after a long period should not exceed several percent, and c. the rubber should be capable of withstanding temperatures (T° C) comprised within the range $-10 \leq T \leq 70$ without appreciable variations of the resilient properties.

Any material satisfying these operating conditions may be suitable for the fluid-blocking member.

Figure 3:
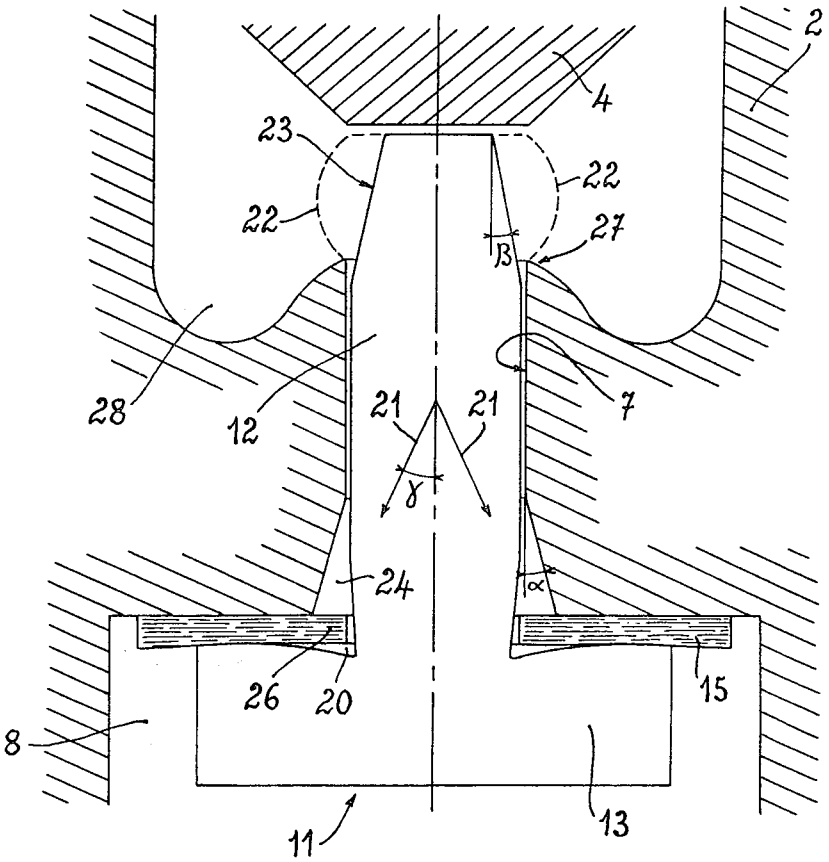
FIG. 3 is an axial sectional view of the valve according to FIG. 2 just before the closed position.
Figure 2:
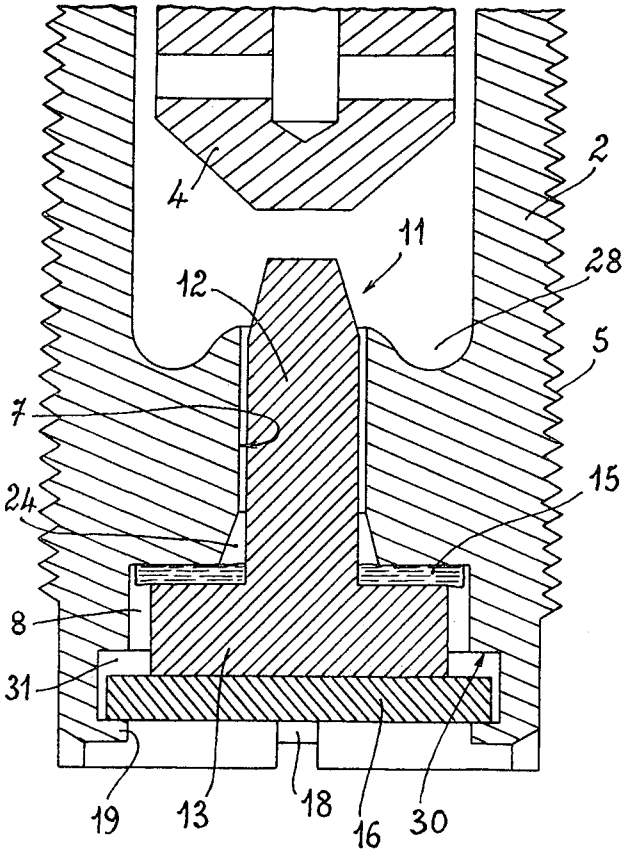
FIG. 2 is an axial sectional view of the pressure reduction valve (escape valve) and closure valve (stop valve) combination according to a second embodiment, the system being illustrated in the non-compressed state, the stop valve being open.

Another embodiment of the valve according to the invention (fluid blocking member and associated parts) is illustrated in FIGS. 2 and 3 which show simplified views, in longitudinal section, of the fluid blocking member respectively in the unpressurized and pressurized conditions which correspond to the opening and closing of the valve. FIGS. 2 and 3 use the same reference numerals as FIG. 1 to designate similar or identical parts.

In FIG. 3 the vector 21 designates the direction in which the rubber tends to move under the influence of the applied pressure. Simple mathematic calculations show that the angle $\gamma$ should be approximately of the order of 25°.

One could expect the head of the pin 12 of the rubber closure member to tend to expand according to the outline shown in dot-dash line 22, if this part of the closure member was exactly circular/cylindrical. This phenomenon may be avoided (owing to the risk of permanent deformation) by providing, for the head of the wall 12, the shape of a truncated cone as shown at 23 in FIG. 3 for example. It may be assumed that the best results will be obtained within the limit $15° \leq \beta \leq \gamma$, $\beta$ representing the angle shown in FIG. 3.

It has also been found appropriate to provide an annular cavity (surface 20 FIG. 3) around the base of the pin 12, a cavity in which the liquid fuel may accumulate. A cavity of this type results from the deformation of the rubber owing to its compression. The accumulated fuel is released immediately at the time of opening of the stop valve, which thus increases the probability of ignition. If desired, it is possible to increase the volume of this cavity 20 by enlarging the free space 7 which leads into the cavity 8, such that an annular space 24 in the shape of a cone is obtained, which surrounds the base of the pin 12. The angle $\alpha$ formed between the generatrix of this annular space and its central axis should be less than $\gamma$. The annular spaces 20 and 24 also have the beneficial effect of eliminating the axial pressure in the region 26 of the porous washer 15 where the pressure varies according to the compression of the rubber cylinder.

It should also be noted that the introduction of the angles $\alpha$ and $\beta$ facilitates the insertion of the rubber pin into the valve body, at the time of assembly.

If the stop-valve remains open for quite a long period of time, the liquid fuel penetrates and accumulates in the region 27 (FIG. 3), which surrounds the outside of the end of the cavity 7. Up to a certain point, it is possible to prevent this liquid from closing the normal gas orifice if the region 28 is turned back or comprises a hollow. Apart from the pins or projections 19 which limit the minimum compression of the part 13 of the fluid blocking member 11, a member has been provided in the embodiment of FIG. 2 for limiting the corresponding maximum compression. This member consists of an annular shoulder 30 which separates the cavity 8 from a wider cavity 31, in which is housed the counterpressure disc 16. Since the outer edge of the cavity 8, limited by the inner periphery of the shoulder 30, has a smaller surface than the disc 16, the latter is in engagement against the shoulder when the rubber closure member is compressed to the maximum. This measure makes it possible both to avoid any damage to the valve and to facilitate automatic regulation of the flame at the factory. If for example, the maximum compression corresponds to a flame height of 10mm, the minimum compression corresponding to a flame of 35 to 50mm. and the regulation margin corresponding to a rotation of the wheel through 180°, a correct flame is obtained if the valve is firstly screwed downwards to the maximum depth, then rotated in the opposite direction through an angle of approximately 90°.

Figure 4:
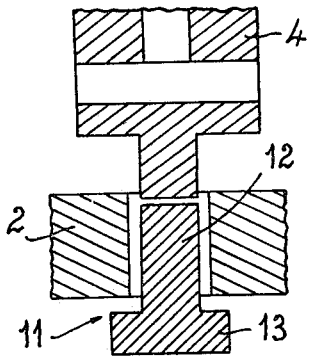
FIGS. 4, 5 and 6 are similar but simplified sectional views showing three additional embodiments of the device according to the invention.
Figure 5:
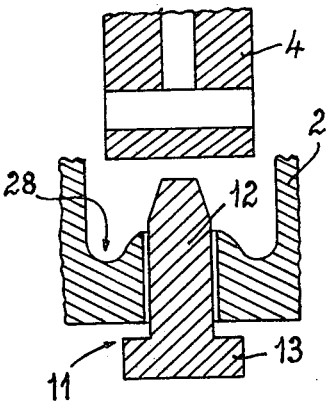
Figure 6:
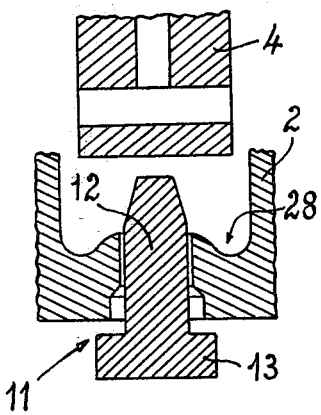

FIGS. 4 to 6 which do not require explanation and in which the same reference numerals as FIGS. 1 to 3 have been used to designate similar parts, are longitudinal sections which illustrate three other embodiments of the invention.

Naturally, the embodiments and applications described above and illustrated in the drawings constitute solely non-limiting examples and may be modified in detail in various ways without diverging from the scope of the following Claims. Thus, the shape and material used for the fluid blocking member 11 may vary greatly. For example, it is possible for this closure member to have the outline illustrated in FIG. 3 in its unpressurized state.

I claim:

1. A valve system comprising:

a housing connectable with a fluid source;

means forming a pressure-control valve in said housing;

means forming a flow-blocking valve in said housing, both of said means having a valve member in common, said member being composed of elastomeric material, said member having a first portion forming part of said pressure-control valve and a second portion forming part of said flow-blocking valve, said second portion comprising a cylindrical stem and said first portion is a disk-shaped base unitary with said stem, said housing being formed with an outlet and a narrow passage receiving said stem with a narrow clearance;

means for axially compressing said stem to expand the same against the wall of said passage to block flow of fluid therethrough, said housing being formed with an enlarged compartment receiving said base and communicating with said passage, said housing being formed between said compartment and said passage with an annular surface; and an annular washer of porous and compressable material forming part of said pressure control valve and compressed between said base and said annular surface around said stem.

2. The system defined in claim 1 wherein said stem is formed as a truncated cone in the direction of the means for compressing same.

3. The system defined in claim 1, further comprising a rigid disk underlying said base and bearing against said housing for maintaining said base under axial compression.

4. The system defined in claim 3 for a lighter in which said source of fluid is a receptacle for liquefied gas having a flange underlying said disk and retaining said base under compression.

5. The system defined in claim 4 wherein said receptacle is formed with angularly spaced projections engageable with said disk.

6. In a cigarette lighter comprising a housing containing a supply of a liquefied gaseous fuel and having a threaded bore and a fuel passage communicating with said bore and extending from said supply, the improvement which comprises an adjustable valve for controlled release of said fuel, said valve being mounted as a unit on said housing and comprising:

a tubular valve body threaded into said bore and formed at an end turned toward said supply with an axially open recess, an axially extending passage formed in said body and communicating with said recess, and an axial bore extending from said passage through the remainder of said body;

an axially shiftable nozzle-forming member received in said axial bore of said body and displaceable toward and away from said passage;

a valve member received in said passage and said recess and having a stem defining a narrow clearance with a wall of said passage and expandable into sealing engagement with said wall upon axial depression of said stem by said nozzle-forming member to block gas flow through said passage, said valve member having an annular flange integral with said stem and juxtaposed with a wall of said recess around said passage; and a gas-permeable washer interposed between said flange and said wall of said recess, said stem and flange of said valve member being each composed at least in part of an elastomeric material.

7. A valve system comprising:

a housing connectable with a fluid source;

means forming a pressure-control valve in said housing;

means forming a flow-blocking valve in said housing, both of said means having an imperforate valve member in common, said member being composed of elastomeric material and having:

a first portion forming part of said pressure-control valve and constituted as a disk-shaped base, and a second portion forming part of said flow-blocking valve and constituted as a cylindrical stem unitary with said base;

means forming a narrow passage for a fluid from said source and receiving said stem with a narrow clearance; and means for axially compressing said stem to expand the same against the wall of said passage to block flow of fluid therethrough.

8. A valve system comprising:

a housing connectable with a fluid source;

means forming a pressure-control valve in said housing;

means forming a flow-blocking valve in said housing, both of said means having an imperforate valve member in common, said member having composed of elastomeric material and having:

a first portion forming part of said pressure-control valve and constituted as a disk-shaped base, and a second portion forming part of said flow-blocking valve and constituted as a cylindrical stem unitary with said base;

means forming a narrow passage for a fluid from said source and receiving said stem with a narrow clearance; and a porous washer surrounding said stem and adjustably pressed between said base and said means forming said passage.

9. The valve system defined in claim 8 wherein said stem is formed as a truncated cone in the direction of said means for compressing said stem.

10. The valve system defined in claim 7 wherein said housing is formed with a bore and said means forming said passage is a member threaded into said bore and having formations engaging behind said base.

* * * * *